US009966050B2

(12) United States Patent
Krol et al.

(10) Patent No.: US 9,966,050 B2
(45) Date of Patent: May 8, 2018

(54) INSTRUMENT MOUNTING ASSEMBLY

(71) Applicant: DRUM WORKSHOP, INC., Oxnard, CA (US)

(72) Inventors: Andrzej J Krol, Wayne, NJ (US); Victor Filonovich, Clifton, NJ (US); Sergio G. Bonsignore, Ridgewood, NY (US)

(73) Assignee: DRUM WORKSHOP, INC., Oxnard, CA (US)

( * ) Notice: Subject to any disclaimer, the term of this patent is extended or adjusted under 35 U.S.C. 154(b) by 0 days. days.

(21) Appl. No.: 14/523,596

(22) Filed: Oct. 24, 2014

(65) Prior Publication Data

US 2015/0114205 A1 Apr. 30, 2015

Related U.S. Application Data

(60) Provisional application No. 61/896,022, filed on Oct. 25, 2013.

(51) Int. Cl.
*G10D 13/02* (2006.01)
*G10D 13/06* (2006.01)
*G10G 5/00* (2006.01)

(52) U.S. Cl.
CPC ..... *G10D 13/06* (2013.01); *G10D 13/026* (2013.01); *G10G 5/005* (2013.01)

(58) Field of Classification Search
USPC ..... 84/403
See application file for complete search history.

(56) References Cited

U.S. PATENT DOCUMENTS 4,126,075 A * 11/1978 Kurosaki ..... G10G 5/00 84/421
4,127,053 A 11/1978 Cohen
4,185,811 A 1/1980 Long ..... 269/216
4,466,596 A 8/1984 Cohen ..... 248/231.41
5,544,561 A * 8/1996 Isomi ..... G10D 13/026 224/910
5,684,258 A * 11/1997 Liao ..... G10D 13/00 224/910
5,703,306 A * 12/1997 Liao ..... F16M 13/02 248/229.11
5,973,249 A * 10/1999 Liao ..... G10D 13/026 84/421
6,093,878 A * 7/2000 Hoshino ..... G10D 13/06 248/122.1

(Continued)

*Primary Examiner* — Christopher Uhlir
(74) *Attorney, Agent, or Firm* — Koppel, Patrick, Heybl & Philpott

(57) ABSTRACT

A mounting assembly configured for detachably mounting a percussion instrument to an instrument stand is disclosed. The assembly has an instrument mounting assembly that has a clamp bracket, a clamp, and a wing screw. An instrument is held to the instrument mounting assembly by placing a mountable portion of the instrument between a set of notches carved out of a first and a second side of the clamp bracket and a clamp. The instrument is secured in the bracket by screwing the wing nut through a hole in a third side of the clamp bracket to cause the clamp to apply a force against the mountable portion of the instrument such that the instrument is held in place between the notches and a groove of the clamp.

17 Claims, 4 Drawing Sheets

(56) References Cited

U.S. PATENT DOCUMENTS

| | | | | |
|---|---|---|---|---|
| 6,096,956 | A * | 8/2000 | Hoshino | G10D 13/06 84/421 |
| 6,274,797 | B1 * | 8/2001 | Liao | G10D 13/06 84/327 |
| 6,424,723 | B1 | 7/2002 | Jing | 381/361 |
| 6,815,598 | B1 * | 11/2004 | Liao | G10D 13/06 84/327 |
| 7,943,840 | B2 * | 5/2011 | Yoshino | G10D 13/026 84/421 |
| 7,964,781 | B1 * | 6/2011 | Lovvorn | G10D 13/06 84/327 |
| 8,563,841 | B1 | 10/2013 | Good | 84/411 |
| 9,024,163 | B2 * | 5/2015 | Sato | G10D 13/02 84/421 |
| 9,390,692 | B2 | 7/2016 | Good | 84/411 |
| 9,613,603 | B2 * | 4/2017 | Allen | G10D 13/026 |
| 2014/0026735 | A1 * | 1/2014 | Sato | G10D 13/02 84/421 |
| 2016/0155432 | A1 | 6/2016 | Krol et al. | 248/206 |

* cited by examiner

INSTRUMENT MOUNTING ASSEMBLY

This application claims the benefit of priority to U.S. Provisional Patent Application Ser. No. 61/896,022 filed Oct. 25, 2013.

FIELD OF THE DISCLOSURE

The present disclosure generally relates to musical instruments and more particularly to assemblies for mounting percussion instruments to an instrument stand.

BACKGROUND

The statements in this section merely provide background information related to the present disclosure and may not constitute prior art.

The jawbone is a traditional Latin percussion instrument comprising the jaw of a medium-sized animal, typically a mule, horse or donkey. A jawbone player holds one half in one hand and strikes the other with either a stick or their hand, causing the teeth to rattle against the bone, creating a loud, untuned sound. Animal jawbones are typically not very durable and prone to breakage when used in this manner. In order to reproduce the sound created by the jawbone instrument, the vibraslap, described in U.S. Pat. No. 4,127,053 to Cohen, was developed. The vibraslap provides the same sound profile of the jawbone instrument in a more durable, consistent, and compact form factor. Mounting the vibraslap in a location accessible to a player during a performance is desirable.

SUMMARY

This Summary is provided to introduce a selection of concepts. These concepts are further described below in the Detailed Description section. This Summary is not intended to identify key features or essential features of this disclosure's subject matter, nor is this Summary intended as an aid in determining the scope of the disclosed subject matter.

Aspects of the present disclosure meet the above-identified needs by providing mounting assemblies configured to removably attach a percussion instrument to a percussion stand rod.

In one aspect, a mounting assembly comprises an eyebolt bracket assembly, a shock absorbing element, and a clamp bracket assembly. The eyebolt bracket assembly removably attaches to a percussion stand rod. The eyebolt assembly may be tightened onto the percussion stand rod via an eyebolt wingnut or similar fastener. On an end portion, the eyebolt bracket assembly is connected to the shock absorber at a shock absorber first end portion. At a shock absorber second end portion, the shock absorber is connected to the clamp assembly. The clamp assembly is configured to removably attach to an instrument, such as a vibraslap or other instruments or objects apparent to those skilled in the relevant art(s) after reading the description herein. The clamp assembly may be tightened onto an arm of the vibraslap instrument via a wing screw or similar fastener.

Further features and advantages of the present disclosure, as well as the structure and operation of various aspects of the present disclosure, are described in detail below with reference to the accompanying drawings.

BRIEF DESCRIPTION OF THE DRAWINGS

The features and advantages of the present disclosure will become more apparent from the Detailed Description set forth below when taken in conjunction with the drawings in which like reference numbers indicate identical or functionally similar elements.

DETAILED DESCRIPTION

The present disclosure is directed to instrument mounting assemblies. In an aspect, a mounting assembly configured to removably attach a vibraslap or other instrument to a percussion stand rod is disclosed.

Figure 1:
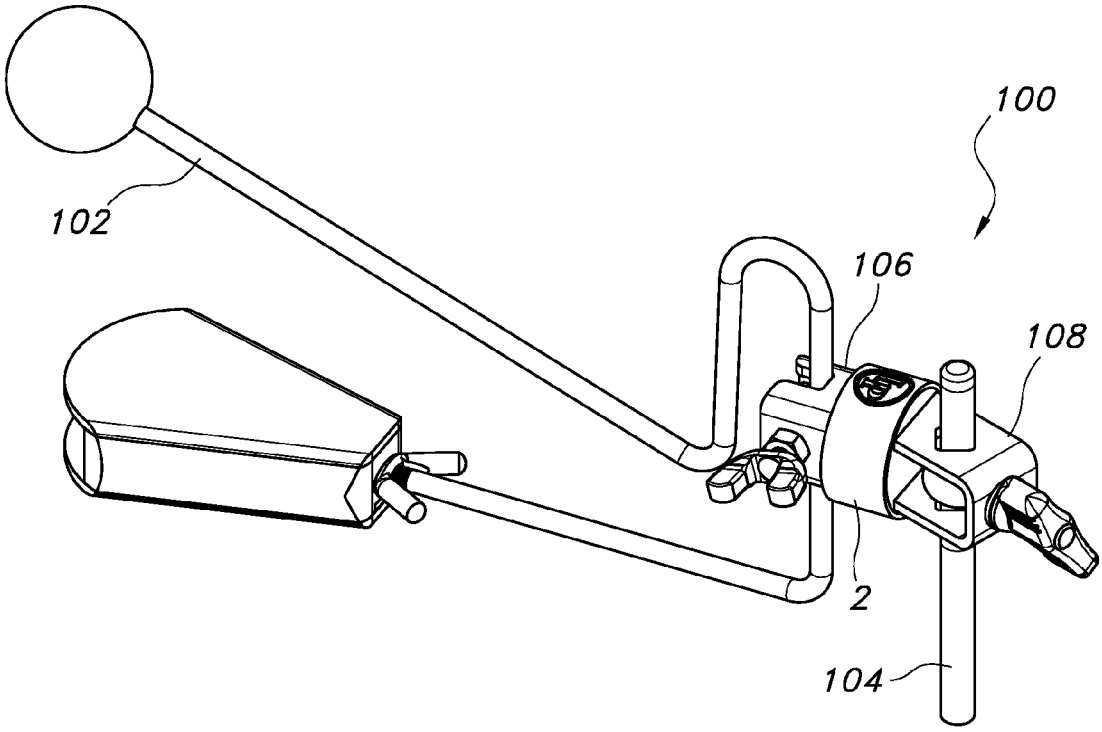
FIG. 1 is a perspective view of a mounting assembly in use, according to an aspect of the present disclosure.

Referring to FIG. 1, a perspective view of a mounting assembly 100 in use, according to an aspect of the present disclosure, is shown.

Assembly 100 may be at least partially constructed of metal, plastic, wood, rubber, and other suitable materials. Assembly 100 may removably mount an instrument or other object, such as a vibraslap 102, to a vertical member 104, such as a percussion stand rod. In this manner, assembly 100 facilitates removably mounting vibraslap 102 to a traditional percussion instrument stand for use during a performance or practice.

In an aspect, assembly 100 comprises a stand mounting assembly 108, a shock absorber 2, and an instrument mounting assembly 106. Stand mounting assembly 108 is configured to removably connect assembly 100 to a stand, such as vertical member 104. Shock absorber 2 is configured to allow attached percussion instruments to be repeatedly struck without damaging the instrument, the stand or assembly 100. Shock absorber 2 may be made out of rubber, thereby allowing the mounting assembly to absorb shock and reduce vibrations when a user strikes the instrument held by the instrument mounting assembly. Instrument mounting assembly 106 is configured to removably connect to an instrument or object, such as vibraslap 102 via a vibraslap arm.

Figure 2:
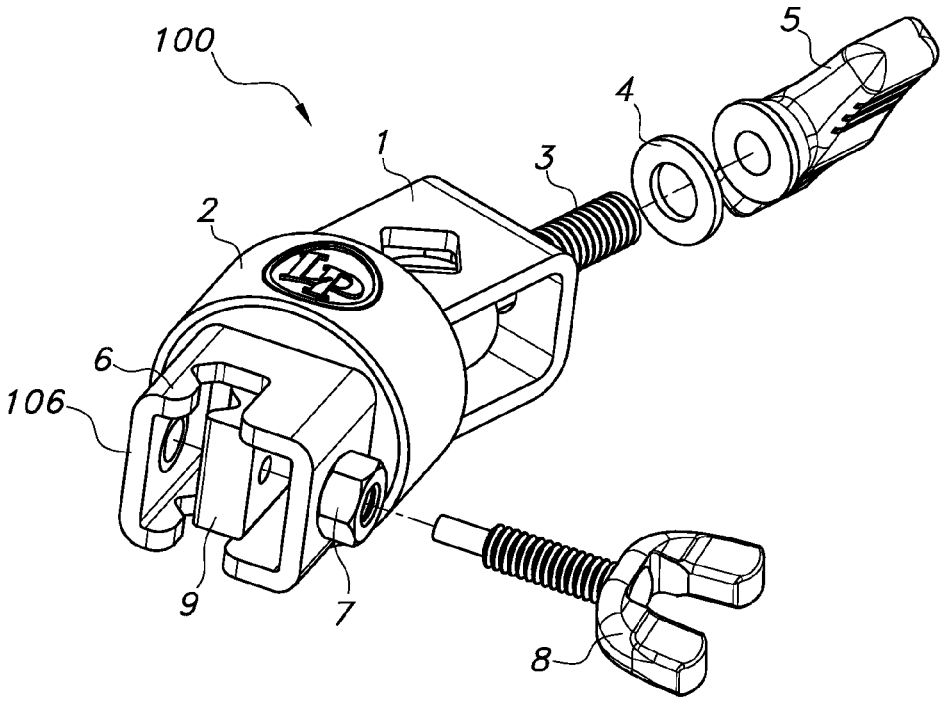
FIG. 2 is a perspective view of a mounting assembly, according to an aspect of the present disclosure.

Referring now to FIG. 2, a perspective view of mounting assembly 100, according to an aspect of the present disclosure, is shown.

In an aspect, assembly 100 comprises stand mounting assembly 108, shock absorber 2, and instrument mounting assembly 106. Stand mounting assembly 108 comprises an eyebolt bracket 1, an eyebolt 3, a washer 4, and an eyebolt wingnut 5. Stand mounting assembly 108 removably attaches to vertical member 104 via tightening eyebolt 3 using eyebolt wingnut 5. As will be apparent to those skilled in the relevant art(s) after reading the description herein, other fasteners and assemblies may be used.

Figure 3:
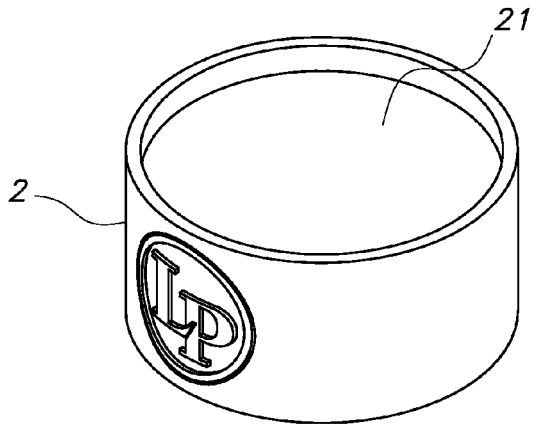
FIG. 3 is a perspective view of a shock absorber according to an aspect of the present disclosure.

On an end portion, stand mounting assembly 108 is connected to shock absorber 2, a perspective view of which is shown in FIG. 3, at a shock absorber first end portion. At a shock absorber second end portion, shock absorber 2 is connected to instrument mounting assembly 106. The shock absorber 2 may have a depression 21 on the first end portion and on the second end portion (not shown) to receive a base of the stand mounting assembly 108 and a base of the instrument mounting assembly 106. As such, the shock absorber 2 is sandwiched between the base of the stand mounting assembly 108 and the base of the instrument mounting assembly 106.

Instrument mounting assembly 106 is configured to removably attach to vibraslap 102, or other instruments or objects apparent to those skilled in the relevant art(s) after reading the description herein. Instrument mounting assembly 106 may be tightened onto a mountable portion of vibraslap 102, such as the vibraslap arm, via a wing screw 8 or similar fastener. The vibraslap may be held in a vertical orientation, as shown in FIG. 1, or in a horizontal orientation (not shown).

In an aspect, instrument mounting assembly 106 comprises a clamp bracket 6, a clamp 9, a hex nut 7 and wing screw 8.

Figure 4:
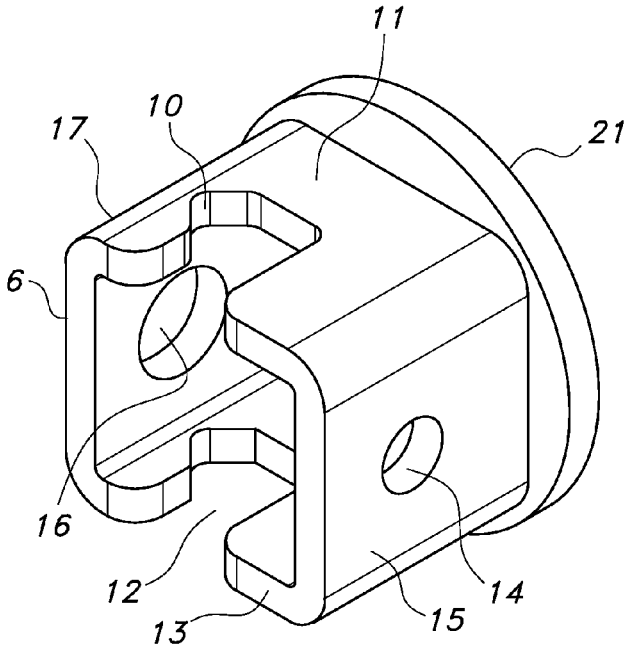
FIG. 4 is a perspective view of a clamp bracket according to an aspect of the present disclosure.
Figure 8:
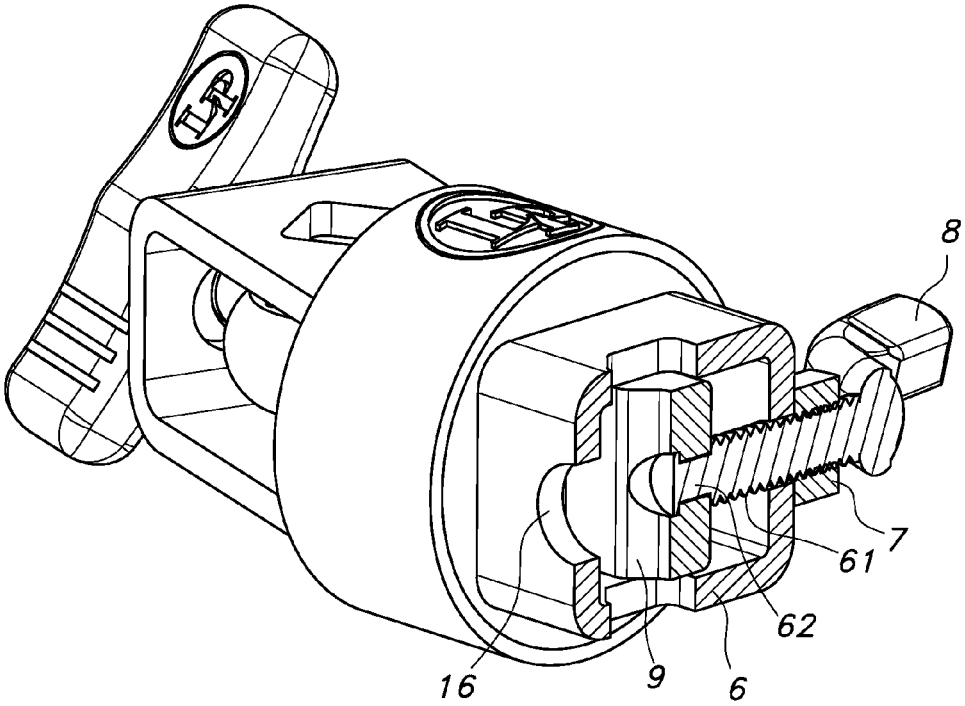
FIG. 8 is a cross sectional view of a mounting assembly according to an aspect of the present invention.

FIG. 4 is a perspective view of a clamp bracket 6 according to an aspect of the present disclosure. The clamp bracket 6 further comprises a first notch 10 on a first side 11 and a second notch 12 on a second side 13 opposing the first side. The first notch 10 and the second notch 12 allow the claim bracket 6 to receive the vibraslap arm. The clamp bracket 6 has a first hole 14 on a third side 15 and a second hole 16 on a fourth side 17 opposing the third side. The first hole may receive the wing screw 8. The second hole 16 serves as an access hole for a bucking bar that may be used to flatten (buck) the end (tip) 62 of the wing screw 8, as shown in FIG. 8. The clamp bracket 6 further has a base 21 that is fixedly connected to the shock absorber 2 through a molding or other suitable process. The clamp bracket 6 may be made of steel or other suitable material.

Figure 5:
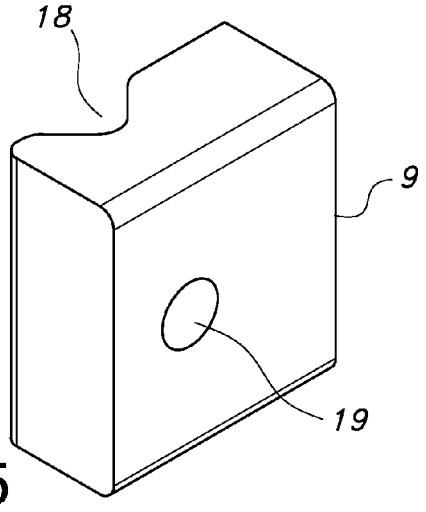
FIG. 5 is a perspective view of a clamp according to an aspect of the present disclosure.

FIG. 5 is a perspective view of a clamp 9 according to an aspect of the present disclosure. The clamp 9 is housed by the clamp bracket 6 as shown in FIG. 2. The clamp 9 comprises a groove (countersink) 18 that allows the clamp 9 to hold the vibraslap arm. The clamp 9 also has a hole 19 that passes through the clamp 9 for receiving the wing screw 8.

Figure 6:
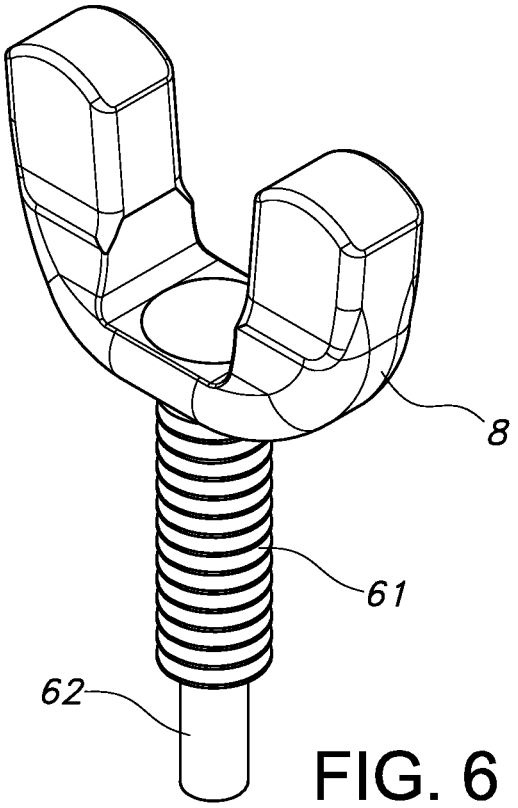
FIG. 6 is a perspective view of a wing screw according to an aspect of the present disclosure.

FIG. 6 is a perspective view of a wing screw 8 according to an aspect of the present disclosure. The wing screw 8 may receive the hex nut 7 along its stem. The wing screw 8 further has a threaded portion 61 and an unthreaded end (tip) 62. The threaded portion 61 allows the wing screw 8 to engage with the hex nut 6 and to be screwed into the first hole of the clamp bracket 6. The wing screw 8 passes through the first hole 14 of the clamp bracket 6 and the end 62 inserts in the hole 19 of the clamp 9. The end 62 on the wing screw 8 is bucked to form a buck tail (mushroom head). As such, the wing screw 8 is fixedly connected to the clamp 9 and traps the clap 9 in the clamp bracket 8, as shown in FIG. 8. The clamp 9 may move within the clamp bracket 6 by screwing or unscrewing the wing screw 8. The clamp 9 may securely hold the vibraslap arm in place between its groove and the first notch and the second notch, as shown in FIG. 1, by screwing the wing screw 8 such that the clamp 9 applies a force against the vibraslap arm.

Figure 7:
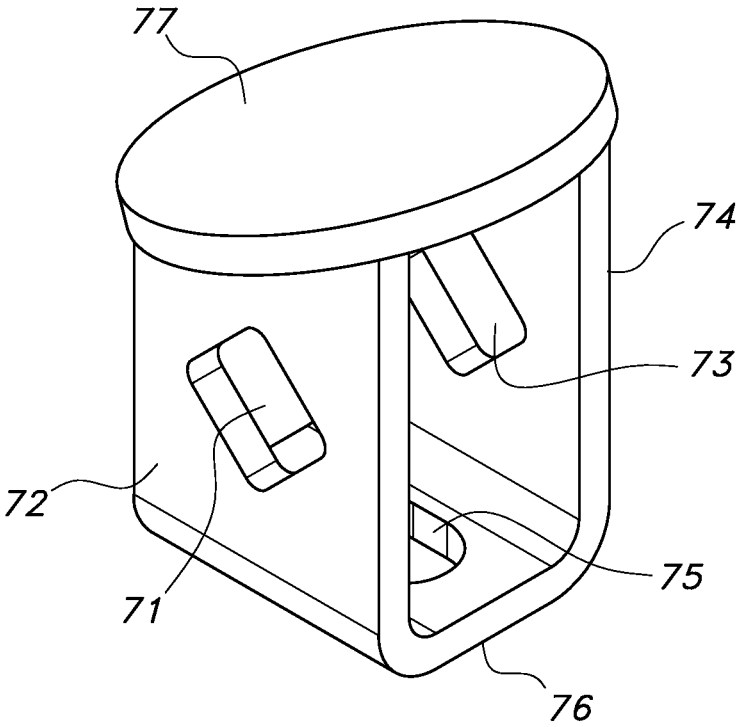
FIG. 7 is a perspective view of an eyebolt bracket according to an aspect of the present disclosure.

FIG. 7 is a perspective view of an eyebolt bracket 1 according to an aspect of the present disclosure. The eyebolt bracket 1 has a first hole 71 on a first side 72 and a second hole 73 on a second side 74 opposing the first side. The eyebolt bracket 1 also has a top hole 75 on a top side 76 and a base 77 that is fixedly connected to the shock absorber 2 through a molding or other suitable process. As such, the shock absorber 2 is sandwiched between the clamp bracket 6 and the eyebolt bracket 1. An eyebolt 3 having an eyebolt portion and a threaded portion is disposed within the eyebolt bracket 1 such that the threaded portion passes through the top hole 75. The threaded portion may receive a washer 4 on its stem. The washer 4 acts as a buffer between the eyebolt bracket 1 and the wing nut 5. The wing nut 5 may be screwed onto the stem to secure the eyebolt 3 to the eyebolt bracket 1. When the eyebolt is held in place, an eyebolt opening of the eyebolt portion preferably aligns with the first hole 71 and the second hole 73 such that a vertical instrument stand rod may pass through the first hole, the eyebolt opening, and the second hole and be held in place by a friction fit when the wing nut 5 is screwed to hold the eyebolt 3 to the eyebolt bracket 1.

While various aspects of the present disclosure have been described above, it should be understood that they have been presented by way of example and not limitation. It will be apparent to persons skilled in the relevant art(s) that various changes in form and detail can be made therein without departing from the spirit and scope of the present disclosure. Thus, the present disclosure should not be limited by any of the above described exemplary aspects.

In addition, it should be understood that the figures in the attachments, which highlight the structure, methodology, functionality and advantages of the present disclosure, are presented for example purposes only. The present disclosure is sufficiently flexible and configurable, such that it may be implemented in ways other than that shown in the accompanying figures (e.g., implementations connecting with percussion instruments other than those mentioned herein). As will be appreciated by those skilled in the relevant art(s) after reading the description herein, certain features from different aspects of the systems, methods and apparatuses of the present disclosure may be combined to form yet new aspects of the present disclosure.

What is claimed is:

1. A mounting assembly configured to removably attach a percussion instrument to an instrument stand rod, the mounting assembly comprising:

a stand mounting assembly;

an instrument mounting assembly comprising a clamp and a clamp bracket, said instrument mounting assembly configured to hold an instrument between said clamp and said clamp bracket; and a shock absorber sandwiched between said stand mounting assembly and said instrument mounting assembly, said shock absorber comprising a first end shaped to define a first depression to receive said stand mounting assembly, and comprising a second end shaped to define a second depression to receive said instrument mounting assembly.

2. The mounting assembly of claim 1, the stand mounting assembly comprising:

an eyebolt bracket; and an eyebolt at least partially within said eyebolt bracket.

3. The mounting assembly of claim 2, wherein the eyebolt bracket is shaped to define a first hole, a second hole opposite said first hole, and a third hole, said eyebolt through said third hole, and said first and second holes configured such that a percussion stand rod can pass therethrough.

4. The mounting assembly of claim 1, wherein said first end of said shock absorber abuts said stand mounting assembly, and wherein said second end of said shock absorber abuts said instrument mounting assembly.

5. The mounting assembly of claim 1, wherein said instrument mounting assembly further comprises a screw;

wherein said clamp bracket is shaped to define a clamp bracket hole;

wherein said screw is through said clamp bracket hole; and wherein screwing or unscrewing of said screw is operable to adjust a position of said clamp within said clamp bracket.

6. The mounting assembly of claim 1, wherein said clamp bracket is shaped to define first and second notches; and wherein a position of said clamp within said clamp bracket is adjustable so as to secure an instrument between said clamp and said clamp bracket at least partially within said first and second notches.

7. The mounting assembly of claim 6, wherein said clamp is shaped to define a third notch; and wherein the position of said clamp within said clamp bracket is adjustable so as to secure an instrument between said clamp and said clamp bracket at least partially within each of said first notch, said second notch, and said third notch.

8. The mounting assembly of claim 7, wherein said first notch and said second notch are on opposite sides of said clamp bracket.

9. An instrument mounting assembly for securing an instrument, said instrument mounting assembly comprising:

a clamp bracket shaped to define a first notch and a second notch;

a clamp at least partially within said clamp bracket, said clamp linearly movable so as to secure an instrument between said clamp and said clamp bracket at least partially within said first notch and said second notch; and a shock absorber;

wherein a first end of said shock absorber abuts a base of said clamp bracket, said first end of said shock absorber shaped to define a depression, said base of said clamp bracket at least partially within said depression.

10. The instrument mounting assembly of claim 9, wherein said first notch and said second notch are on opposite sides of said clamp bracket.

11. The instrument mounting assembly of claim 9, wherein said clamp is shaped to define a third notch, said clamp movable so as to secure an instrument between said clamp and said clamp bracket at least partially within said first notch, said second notch, and said third notch.

12. The mounting assembly of claim 5, wherein said clamp is shaped to define a clamp hole, and wherein said screw is at least partially through said clamp hole.

13. The mounting assembly of claim 5, wherein screwing or unscrewing of said screw is operable to linearly adjust the position of said clamp within said clamp bracket.

14. The mounting assembly of claim 7, wherein the position of said clamp within said clamp bracket is linearly adjustable.

15. The mounting assembly of claim 8, further comprising a screw;

wherein said clamp bracket is shaped to define a clamp bracket hole;

wherein said screw is through said clamp bracket hole and operable to linearly adjust the position of said clamp within said clamp bracket.

16. The instrument mounting assembly of claim 11, further comprising a screw operable to linearly move said clamp so as to secure an instrument between said clamp and said clamp bracket at least partially within said first notch, said second notch, and said third notch.

17. The instrument mounting assembly of claim 16, wherein said clamp bracket is shaped to define a clamp bracket hole; and wherein said screw is through said clamp bracket hole.

* * * * *